United States Patent [19]

Turk et al.

[11] 4,002,307

[45] Jan. 11, 1977

[54] LOSS-FREE WINDING APPARATUS

[75] Inventors: Herbert Turk, Remscheid; Herbert Schiminski, Huckeswagen, both of Germany

[73] Assignee: Barmag Barmer Maschinenfabrik Aktiengesellschaft, Wuppertal, Germany

[22] Filed: Dec. 18, 1975

[21] Appl. No.: 642,187

[30] Foreign Application Priority Data

Dec. 23, 1974 Germany ..... 2461223

[52] U.S. Cl. ..... 242/18 A; 242/18 PW

[51] Int. Cl.[2] ..... B65H 54/06; B65H 67/04

[58] Field of Search ..... 242/18 A, 18 PW, 18 R

[56] References Cited

UNITED STATES PATENTS

| | | | |
|---|---|---|---|
| 3,345,003 | 10/1967 | Mattingly et al. | 242/18 A |
| 3,370,798 | 2/1968 | Hagihara et al. | 242/18 A |
| 3,561,688 | 2/1971 | Hagihara et al. | 242/18 A |
| 3,625,442 | 12/1971 | DiMeglio | 242/18 A |
| 3,688,998 | 9/1972 | Carr et al. | 242/18 A |
| 3,695,521 | 10/1972 | Torii et al. | 242/18 A |
| 3,913,852 | 10/1975 | Lenk et al. | 242/18 A |

*Primary Examiner*—Stanley N. Gilreath
*Attorney, Agent, or Firm*—Johnson, Keil, Thompson & Shurtleff

[57] ABSTRACT

Apparatus for the loss-free winding of a continuously supplied thread to winding packages at a high winding speed, in which the thread is wound with transverse motion with loss-free transfer of the thread from a nearly wound bobbin to an empty bobbin on a chuck of a bobbin revolver. Loss-free thread transfer is attained by an auxiliary thread guide with a guide edge slanted laterally and outwardly relative to the traverse triangle and terminating in a thread catching eye. The auxiliary thread guide catches the thread in the traverse triangle when moved into the plane thereof, after which the guide is pivoted outwardly and downwardly into a zone where the thread is caught by thread catching means on the empty bobbin or its chuck. The downwardly extending thread loop runs over a mandrel having a biconical midportion and a radial arm shiftable laterally along one conical surface in the axial direction of the mandrel. The mandrel functions to initially restrain the thread against movement into the range of the traverse guide to wind a transfer tail on the empty bobbin.

10 Claims, 8 Drawing Figures

LOSS-FREE WINDING APPARATUS

The present invention pertains to apparatus for guiding and severing thread being wound on a full bobbin with loss-free transfer of the thread to a rotating empty bobbin, particularly two or more bobbins mounted on respective chucks supported in cantilever fashion on a bobbin revolver. The latter orbits the respective chucks and bobbins between winding position, thread transfer position and wound bobbin-removal position.

In German published application No. 2,316,218 and corresponding U.S. application Ser. No. 456,222, now U.S. Pat. No. 3,913,852, winding devices embodying two or more chucks cantilevered on a bobbin revolver have associated therewith an auxiliary thread guide for loss-free transfer of the wound thread from a full or finished bobbin to an empty bobbin. This apparatus embodies a friction drive roller rotatably journalled on a vertically movable head, a reverse-thread spindle driving a reciprocating traverse thread guide, said spindle being rotatably journalled on said head with its axis of rotation parallel with the axis of rotation of said drive roller, a rotatable bobbin revolver stoppable in predetermined positions, at least two tube-supporting chucks rotatably journalled on said bobbin revolver in positions wherein, through rotation of the bobbin revolver in a bobbin exchange step, an empty tube on one chuck and the wound bobbin on another chuck simultaneously may be brought into driving contact against the friction roller, and transfer means for transferring the continuously running thread onto the empty tube after it has been accelerated to a high peripheral velocity by the drive roller, the friction drive roller having in the bobbin-driving surface a continuous, spiral thread guide groove extending over the length of the traverse stroke, running in opposite directions, and continuous through the stroke reversal ends of the traverse stroke, and said transfer means including at least one thread guide means movable during the thread transfer by said transfer means in a predetermined course of movement wherein the running thread is deflected into the range of action of a thread catching means on the chuck bearing the empty tube or on the empty tube itself.

The known apparatus further embodies a thread guide bow supported on said head and movable into and through the traverse plane of the running thread segment between the reciprocating traverse thread guide and the friction roller, said bow having a first thread guide segment inclined relative to the bobbin axis and a second, notched segment restraining traverse movement of the thread, auxiliary thread guide means movable in guide means, a mandrel adjacent said auxiliary thread guide means, and said guide means guiding the movement of said auxiliary thread guide means first into thread-engaging position when the thread is running in said notched segment, and thereafter guiding said auxiliary thread guide means with the thread engaged therein into a position wherein the running thread forms a loop, one segment of which runs from said auxiliary thread guide means and thereafter across said mandrel, and the other segment of which is deflected into engagement with said thread catching means.

The thread guide bow is mounted by means for moving said bow from a starting position below said head and behind said traverse plane outwardly through said traverse plane of said running thread in a combination wherein the thread guide bow is pivotally supported by means for swinging the thread guide bow through the traverse plane of the thread running between the traverse thread guide and the friction roller, in combination with a piston operatable in a cylinder by fluid pressure means, the piston rod of which is articulated on the thread guide bow to swing it through said traverse plane.

The transfer means includes an auxiliary thread guide, a cylinder having a longitudinal guide track in a wall thereof, a piston movable in said cylinder, said auxiliary thread guide being mounted on said piston, a pair of cables extending longitudinally in said cylinder and connected to opposite sides of said piston, and fluid pressure operated means for moving said piston and cables longitudinally in said cylinder. In another form, the transfer means includes an auxiliary thread guide mounted on a piston rod which is reciprocable in a cylinder, guide track means extending longitudinally on said rod and configured to rotate the rod as it moves longitudinally, fluid pressure means for reciprocating said rod in said cylinder and fixed means in said cylinder interacting with said guide track means to cause said rod to revolve in accord with the configuration of the guide track means as it reciprocates in said cylinder.

In the latter transfer means, the piston rod is a double-walled cylindrical tube, the inner tube of which bears the piston and is slit longitudinally to provide said guide track means, and said inner tube being encased in a coaxial outer tube sealing said double-walled tube against losses of the fluid pressure medium.

During the thread transfer, the thread, after being caught by the rotating empty tube, is severed. The cutting means may be cutting edges on a thread catching disk which is arranged coaxially with the chuck shaft of the tube chuck and having hooks distributed on the circumference or may be thread severing cutters distributed on the circumference of the tube chuck shaft and having thread severing edges parallel to the axis of the tube chuck.

The known apparatus further embodies, as the thread reserve-forming means, a thread guide member adjacent one end of the chuck-mounted empty tube, a deflectable pin mounted on said guide member, and adjustable spring loading means for temporarily holding said pin against deflection by the thread running against said pin to form said thread reserve on said one end of said tube.

An object of this invention is to provide improvements in the thread transfer mechanism of high speed winders of the type described above in a loss-free changeover of the running thread between a full bobbin and an empty bobbin or tube. This is attained by elimination of the dwell time in the thread transfer from the thread guide bow to the auxiliary thread guide. Such elimination is desirable inasmuch as, at winding speeds of 3,000 meters per minute or more during the thread transfer, 50 meters of thread per second continue to be delivered during the thread transfer. This segment of the thread is not transferred by the reciprocating traverse guide of the winding machine — leading to reductions in quality of this segment of the wound thread and an irregular winding build up.

The invention has the further objects of providing a thread transfer system which is rugged, is compact, fulfills the overall purpose of loss-free transfer of the thread quickly and efficiently, does not impair the operation of the winder per se, is readily adjustable and is readily assembled and/or replaced in the case of worn parts.

In general, the apparatus of the subject invention utilizes an auxiliary thread guide which is actuated and controlled by a single cylinder-piston unit. This, upon command, will successfully lift the thread out of the traverse triangle (a triangular plane formed by movement of the running thread between a fixed thread guide and a thread traversing mechanism). It automatically catches the lifted thread and draws it into a thread loop and applies the running thread in the thread loop to the empty tube.

The auxiliary thread guide has a thread guide edge which, upon movement of the edge into the traverse triangle, will guide the laterally moving thread in the triangle out of the traverse triangle and also out of the traverse guide which moves the thread through the thread triangle. For this purpose, the thread guide edge is disposed at an obtuse angle relative to the traverse triangle plane and extends in a direction outwardly toward the front of the winder and laterally toward the contiguous end of the traverse triangle. This inclined edge thus automatically lifts the thread out of the traverse guide and, by virtue of the lateral movement still imparted thereto by the spirally grooved traverse roller (which may also be the friction drive roller) the thread moves along the inclined surface to a thread trap.

Conveniently, the thread guide edge and the thread trap are parts of a wire or rod having one end mounted on the vertically movable driven member of the two cylinder-piston unit, e.g., the piston rod. A loop bent in the intermediate part of the thread guide wire or rod forms the thread trap while the free end of the wire or rod extends from the loop and forms the thread guide edge having the orientation previously described. The thread trap is located forwardly of the traverse plane.

When the running thread is caught in the thread trap, the thread guide is rotated about a vertical axis, e.g., the axis of the piston-cylinder unit, away from the traverse plane. Simultaneously or sequentially, the thread guide is moved downwardly to form a running thread loop extending from a guide at the apex of the traverse plane through the thread trap and onto the spirally grooved roller. When the thread guide reaches its lowermost position, the leg or segment of the thread loop between the thread trap and the spirally grooved roller comes in contact with a mandrel, as does the other leg or segment.

The mandrel is fixedly positioned to engage this thread segment or leg with the thread guide in the lowermost position. It is a member with a longitudinal axis extending from its fixed end at an acute angle toward the traverse plane and/or the grooved roller. The mandrel lies completely outside the traverse plane, however. It has on its free or projecting end a thread stop and also carries a thread-engaging pin or rod which is yieldably biased toward the fixed end of the mandrel. Preferably, the mandrel is a substantially cylindrical rod or tube having intermediary bi-conical surfaces. The thread engageable pin or rod is movable axially of the mandrel in the segment of the mandrel at or before the beginning of the frusto-conical part of the bi-conical surface which is remote from the free end thereof and accordingly remote from the traverse triangle and/or traverse zone. The thread-engaging pin or rod preferably has its base inside the mandrel and projects laterally therefrom away from the traverse triangle or grooved traverse roller through a longitudinal slot in the aforesaid frusto-conical portion of the bi-conical surface. The bi-conical surface, in turn, preferably lies in the zone or area of the contiguous stroke reversal or traverse stroke end of the traverse triangle formed between the apexial guide and the thread traverse guide.

The base of the thread-engaging rod or pin is mounted in a member which is axially slidable or movable inside the mandrel, which member is pneumatically-, hydraulically, or mechanically drivable at controlled speed toward the free end of the mandrel.

With this mandrel structure, the thread leg or segment of the thread loop between the fixed guide and the thread trap engages and is slightly deflected by the conical part of the biconical segment which is remote from the free end of the mandrel and on the side of the thread-engaging pin or rod which faces the free end of the mandrel. The running thread segment between the thread trap and the spirally grooved roller is also deflected slightly by the mandrel and is prevented from slipping off the free end of the mandrel by a thread stop. When the running thread has been caught by the empty tube or the chuck upon which the empty tube is mounted and has been cut by cutters associated with such chuck, the aforesaid leg or segment of the running thread is therefore changed from running onto the winding formed on the tube on the other chuck over to a winding initiated on the empty tube.

Initially, the thread leg or segment running onto the thread trap runs over the smallest end of the frusto-conical segment of the bi-conical surface which is remote from the free end of the mandrel. The tangential plane of this frusto-conical segment, which is parallel to the traverse plane, is at an acute angle to the traverse plane and extends in diverging fashion relative to the traverse plane in a direction away from the fixed end of the mandrel. With this orientation, the running thread remains at or adjacent the smaller end of this frusto-conical section. The projecting rod or pin is pushed by the aforesaid mechanism along the mandrel up to at least the point of intersection between the two, back-to-back, frusto-conical sections of the bi-concial surface, thereby pushing the running thread to this intersection. At this point, the thread moves freely down or along the frusto-conical surface of the other frusto-conical section and thence along the mandrel. None of this thread is engaged by the aforesaid thread stop adjacent the free end thereof. A transfer tail or thread reserve is wound on one end of the empty tube while the aforesaid thread leg or segment of the thread loop lies on the first-mentioned frusto-conical section of the bi-conical surface, i.e., until the running thread is pushed by the projecting rod or pin to the intersection of the back-to-back frusto-conical sections.

The aforesaid intersection preferably is substantially aligned with a stroke reversal zone of the spirally grooved roller. The thread then runs down the other bi-conical surface and along the free, unsupported end of the tubular mandrel. The other loop segment is caught by a radially projecting stop to prevent the thread from slipping off the free end of the mandrel and being caught by the thread traverse guide during the traverse motion of the thread during the changeover from the full winding to the empty tube.

In a preferred embodiment of the invention, the single cylinder-piston unit, which motivates the auxiliary thread guide, is a pneumatic unit constructed to stop in multiple positions of the piston movement. Such cylinder-piston unit preferably utilizes a control cam to pivot the piston rod and the auxiliary thread guide thereon via a fixed guide bar or stud slidable in a longitudinally curvate groove in the wall of the piston rod. Preferably, the auxiliary thread guide has a shaft which is adjustably clamped to the projecting end of the piston rod for minor adjustments of the position of the thread guide eye and/or the free end of the thread guide relative to the traverse plane and/or other parts of the winder.

One significant advantage of the thread changeover mechanism of this invention is the compactness of its structural parts. Further, the control of the entire thread changeover process is done with a single, integrated cylinder-piston unit whereby the thread changeover can take place more rapidly than in the case with thread changeover devices having several control parts which must be attuned to differing movements and differing drive units relative to each other in a timed sequence. The subject thread changeover units further better assure consistency of operation for each changeover process because the thread is guided by a single auxiliary thread guide and is applied by it to the empty tube. A still further advantage arises in the favorable operation of the thread changeover device in combination with a multipirning head used for simultaneous winding of several threads in each instance on a chuck tube.

Further advantages and benefits accruing to winding devices and winding processes will be appreciated from the following description of preferred embodiments of the invention, which are illustrated in the accompanying drawings, wherein.

Figure 1:
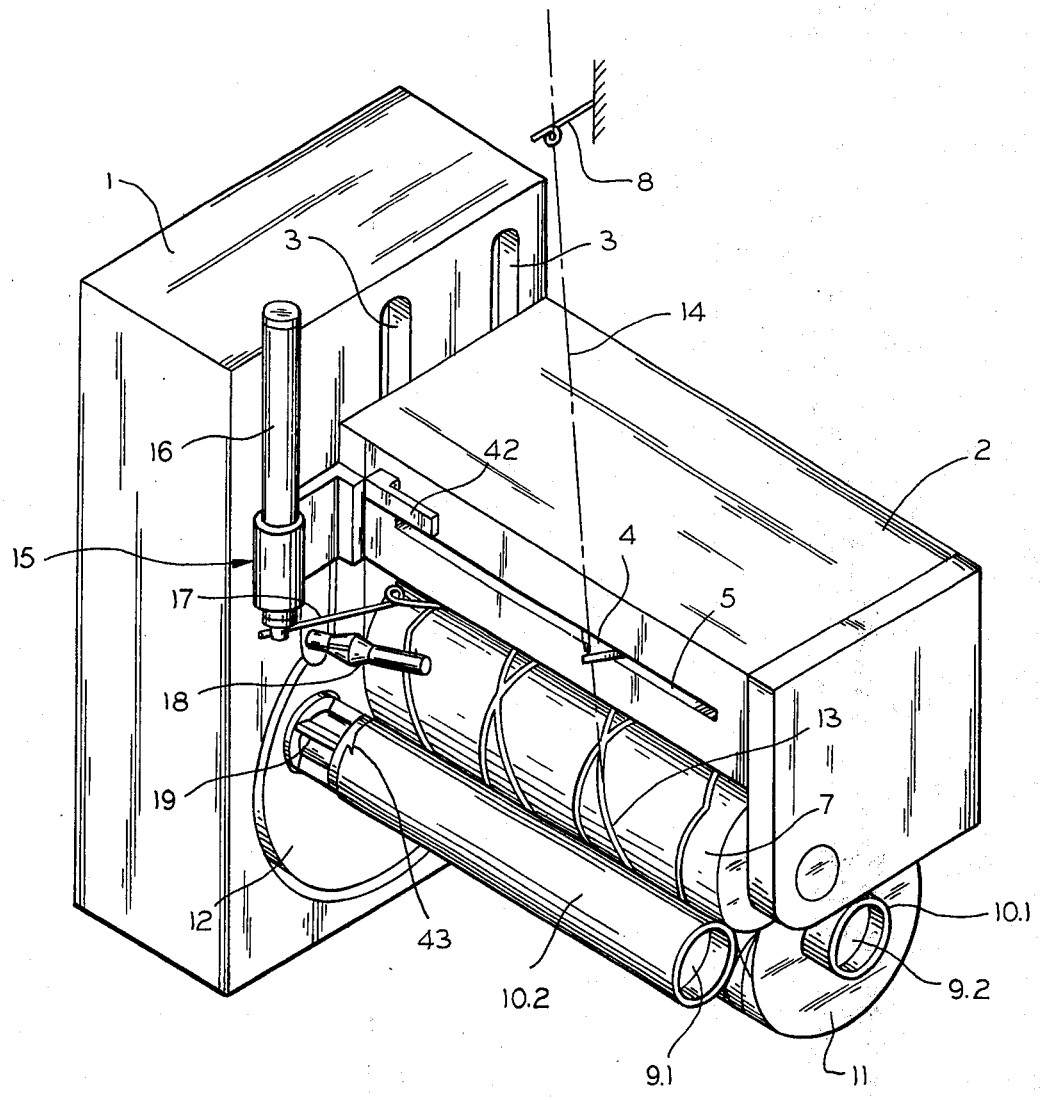
FIG. 1 is a front perspective view of a winding unit embodying a bobbin revolver with two tube chucks thereon and the thread changeover mechanism of the invention.
Figure 2:
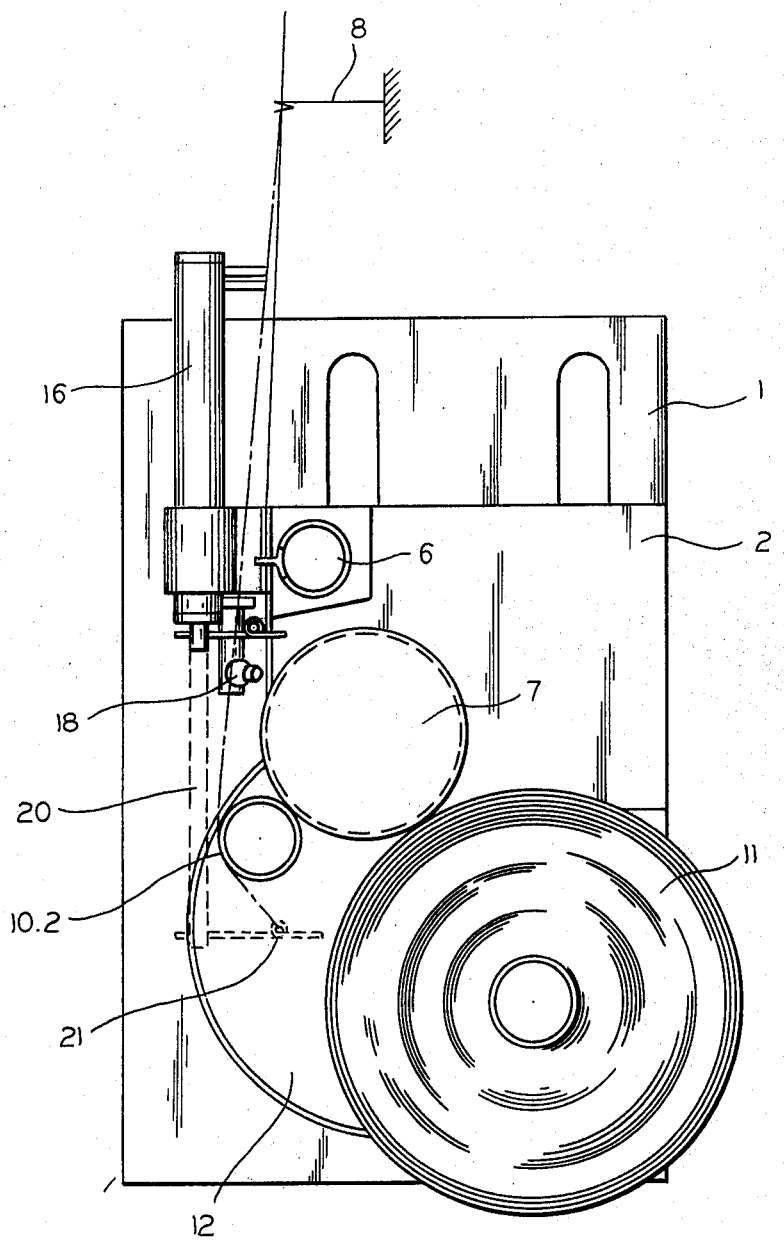
FIG. 2 is a side elevation of the winding unit of FIG. 1.
Figure 3:
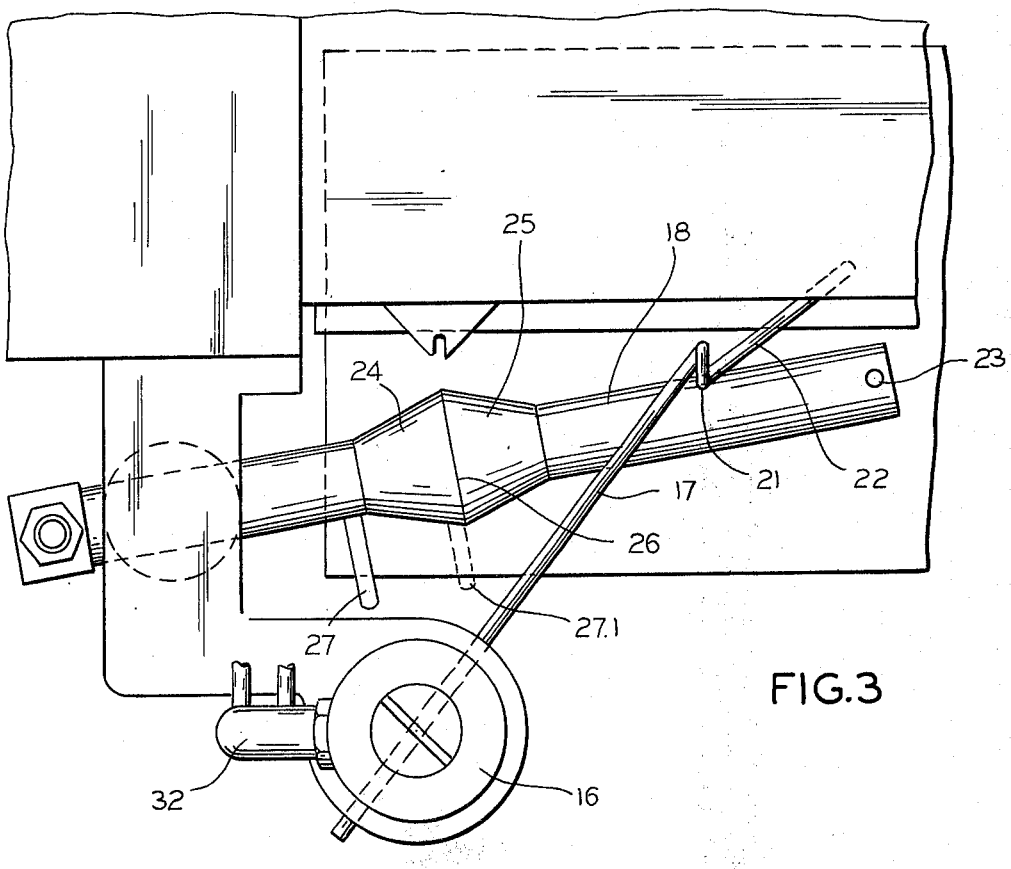
FIG. 3 is a top plan view of a fragment of the thread winding unit of FIGS. 1 and 2 in the area of the thread changeover mechanism.

The winder illustrated in FIGS. 1–3 is of the general type described and illustrated in German Published Application P 23 53 202.7+ It comprises a casing 1 mounted on the frame of a multiposition winding machine (not illustrated). A vertically movable head 2 projects laterally from the casing 1 and is guided in its vertical movement in the vertical guides 3. The head 2 has a horizontally reciprocable thread traverse guide 4 and a friction drive roller 7, which is driven by a synchronous motor (not shown). The thread traverse guide 4 projects from and reciprocates in the horizontal, straight guide slot 5 in the front face of the head 2. It is driven by a cross spiraled roller of known construction, which roller 6 being schematically shown in FIG. 2. The cross-spiral roller is journalled in the head 2 with its axis parallel to the axis of the friction drive roller 7.

+ Also U.S. application Ser. No. 456,222, now U.S. Pat. No. 3,913,852.

The friction drive roller 7 has an endless thread guide groove 13 having spirals of opposite hand and usually one or more crossing points. The thread guide groove 13 also traverses the thread during the normal winding process in a manner known in the art and further will, by itself, cause the thread 14 to traverse during the thread changeover from a full winding to the empty tube 10.2 as well as during the acceleration of the latter tube up to the approximate circumferential speed of the friction drive roller 7. This spirally grooved friction drive roller 7 prevents jamming of the thread between the friction drive roller and the empty tube 10.2 during the changeover step. During the winding step, the thread guide groove 13 of the friction drive roller 7 functions as a revolving thread guide in timed relationship with the reciprocable movement of the traverse guide 4 in such a way that the thread is guided by and remains in the thread guide groove 13 to provide the desired distributing angle of the cross-winding of the thread formed on the winding package.

The winding tubes 10.1, 10.2 are releasably mounted on tube chucks 9.1 and 9.2, which are borne by respective chuck shafts. The chuck shafts are rotatably mounted in the bobbin revolver 12 in cantilever fashion. The bobbin revolver itself is driven in rotation about a defined horizontal axis and is arrestable in a known manner in predetermined bobbin positions by known mechanisms and controls, e.g., German Patent Application P 23 65 384.1[1] In the operating position of the bobbin revolver 12 represented in FIG. 1, the friction roller 7 is still in surface contact with an almost fully wound bobbin 11, from which the thread running from the fixed thread guide 8 is to transfer without loss to the empty tube 10.2. The empty tube 10.2 is in this operating phase of the bobbin revolver likewise driven by surface contact with the drive roller 7 and is accelerated to the peripheral speed of the friction drive roller.

1. Also U.S. application Ser. No. 534,648, filed Dec. 19, 1974.

When the empty tube 10.2 is brought to the circumferential (peripheral) speed of the friction roller 7, the thread change from the wound bobbin 11 to the empty tube is automatically initiated by the thread changeover mechanism 15, which is mounted on the movable head 2. This mechanism consists of the cylinder-piston unit 16 and an auxiliary thread guide 17, a shaped rod which is longitudinally adjustably mounted on the end of the piston rod. The auxiliary thread guide is moved by fluid-pressure-operated piston rod and is guided in a path of movement defined by a control cam, FIG. 6. The thread changeover mechanism 15 also includes a rigid mandrel 18 which is substantially horizontal and diagonally angled toward the traverse plane. The mandrel is positioned beneath the thread changeover unit 16 at a vertical position between the upper and lower positions of the auxiliary thread guide 17. The rod forming the latter has a pigtail or eye 21 for catching the thread 14 as well as, after the catching of the thread, to form a thread reserve on the empty tube. The thread changeover mechanism of the invention is further explained below with the aid of FIGS. 2 and 3 and the following description.

For the severing of the thread loop running through pigtail 21 onto the full bobbin 11 after the thread changeover, there are provided on the tube chucks the thread severing cutters 19, which can also be partially covered by the winding tubes 10.1, 10.2 as shown in German Patent Application P 24 55.116.4.

In FIG. 1 the thread changeover mechanism 15 is illustrated in a position at the moment in which the auxiliary thread guide 17 is swung into the traverse plane with the free end 22 of the guide rod 17 between the reciprocating traverse thread guide 4 and the rotating thread guide, the thread guide groove 13 in the roller 7, in order to intercept and catch the thread 14 running from the traverse thread guide 4. In FIG. 2 the lowermost position of the auxiliary thread guide 17 is shown in phantom lines. Upon extension of the piston rod 20 past the mandrel 18, a thread loop is formed. In this lower end position the thread segment running from the fixed thread guide 8 directly to the auxiliary thread guide 17 is placed against the empty tube 10.2, and the thread segment running to the wound package 11 is severed between the thread catching notch 43 in the end of the tube and the thread catching loop 21 by the thread severing cutters 19 as a result of the increase in thread tension.

In FIG. 3 there is shown a top plan view of the thread changeover mechanism 15 and the geometrical relationship of the auxiliary thread guide 17 in the thread catching position and the rigid mandrel 18. The auxiliary thread guide 17 has a straight shaft and a free end 22, which functions as a thread guide edge. At the transition of the thread guide edge of free end 22 and the straight shaft, the automatic thread catching eye or pigtail 21 functions as a thread trap. The straight shaft of the thread guide is, as is evident from FIG. 5, longitudinally adjustably mounted on the piston rod 20 of the cylinder-piston unit 16, in order to simplify proper positioning of the auxiliary guide 17 in the assembly or the replacement of a damaged thread guide.

Figure 4:
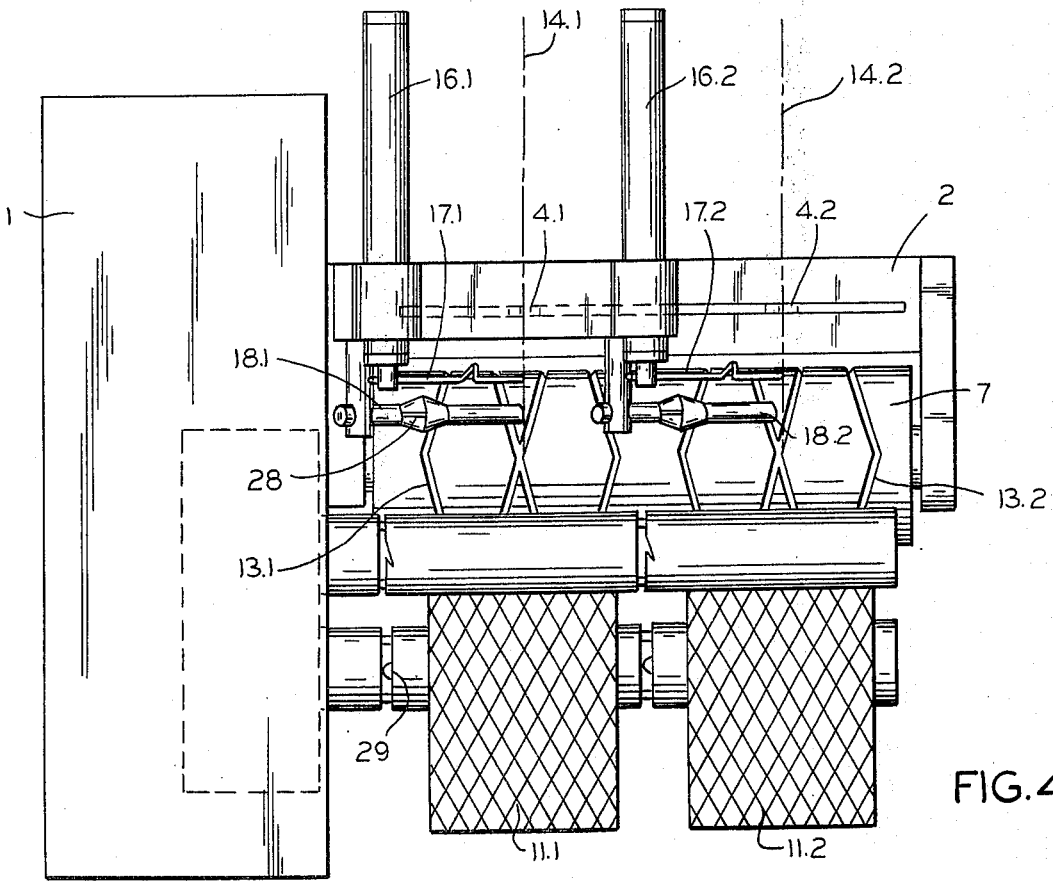
FIG. 4 is a front elevation of a thread winding unit similar to FIGS. 1–3 but having thread traverse mechanisms and two thread changeover units for forming simultaneously two windings axially spaced on the respective winding tubes.

The rigid mandrel 18 preferably is a cylindrical tube. This, as mentioned above, is positioned substantially horizontally between the upper and the lower end positions of the auxiliary thread guide 17 and extends diagonally toward the traverse plane, without, however, penetrating the traverse plane between the reciprocating guide 4 and the grooves 13 of the rotating roller 7. On the projecting end of the mandrel 18 there is a radial, substantially vertical thread stop pin 23. The latter prevents during the thread changeover of the running thread (which continues to be traversed and which partially encircles the mandrel) a slipping of the thread, in which case over the mandrel end the thread would be caught prematurely by the traverse thread guide 4. The mandrel 18 has two opposed slide surfaces 24 and 25 of opposite, acute angles to the remaining thread guiding surface of the mandrel. The surfaces 24 and 25 preferably are formed by back-to-back, biconical segments having a peripheral line of intersection 26 in the vicinity of the end of the traverse stroke of the thread. The thread contact surface on the mandrel 18 is on the side remote from the traverse plane. The thread contact surface of the frusto-conical segment 24 slopes, in the direction toward the free end of the mandrel, away from the traverse plane. This thread contact surface has a pin 27 axially slidably guided in the mandrel 18 in a longitudinal slot 28 in such surface (FIG. 1 and FIG. 4). The purpose of this combination is to form a thread reserve on the empty tube 10.2 after the thread transfer to the empty tube through the controlled movement of the pin 27 in the longitudinal slot 28 into the position 27.1 indicated in phantom in FIG. 3. The thread cannot per se pass automatically along the mandrel toward its full end because of the inclination of the angle of the thread contact surface of the slide surface 24 relative to the traverse plane. The pin 27 is moved in the mandrel 18 and pushes the thread running over the surface 24 to the line of intersection 26, whereupon the thread slides along the surface 25 and free end of the mandrel toward the stop pin 23. Further details are described below.

In FIG. 4 there is shown an advantageous use of the thread changeover mechanism of the invention on a winding machine, in which two bobbins or winding packages 11.1 and 11.2 are wound simultaneously side-by-side on a respective chuck. As is to be seen from FIG. 4, all the parts for traversing, receiving and shifting the threads 14.1 and 14.2 are provided in duplicate vis-a-vis the winder of FIGS. 1–3. By reason of the compact construction of the thread shifting mechanisms comprising the cylinder-piston unit, the auxiliary thread guide driven and guided thereby, and the mandrel, there can be mounted on the head 2 several such devices without impairing the operability and/or tendability of the winder. The duplicate mechanisms and parts correspond to those described above with reference to FIGS. 1—3 as follows: threads 14.1 and 14.2 to thread 14, cross-spiral thread guide grooves 13.1 and 13.2 in roller 7 to grooves 13, piston-cylinder units 16.1 and 16.2 to unit 16, auxiliary thread guides 17.1 and 17.2 to guide 17, and mandrels 18.1 and 18.2 to mandrel 18. With respect to the construction of the chuck and of the thread severing means and the spacer studs 29 on the winding carriers, the latter for spacing the winding tubes, reference is made to the aforesaid German Patent Application P 24 55 116.4 and U.S. application Ser. No. 456,222, filed Mar. 29, 1974. A bobbin head represented in FIG. 4 is suited especially for the winding of endless threads in the textile denier range.

Figure 5:
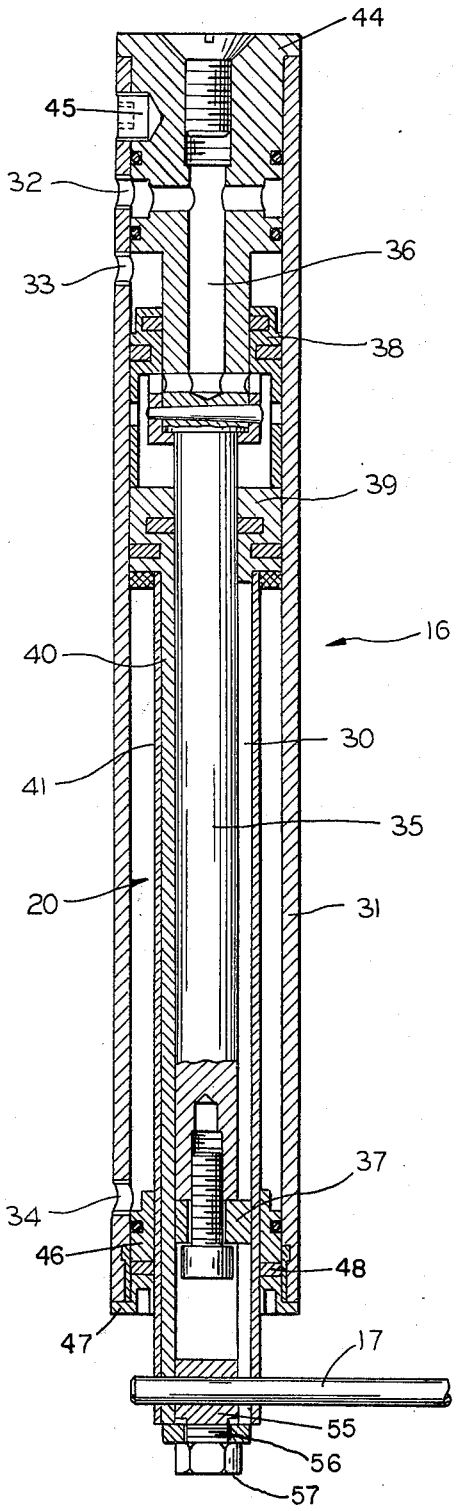
FIG. 5 is a diametric cross section of the single cylinder-piston unit of the thread changeover mechanism.
Figure 6:
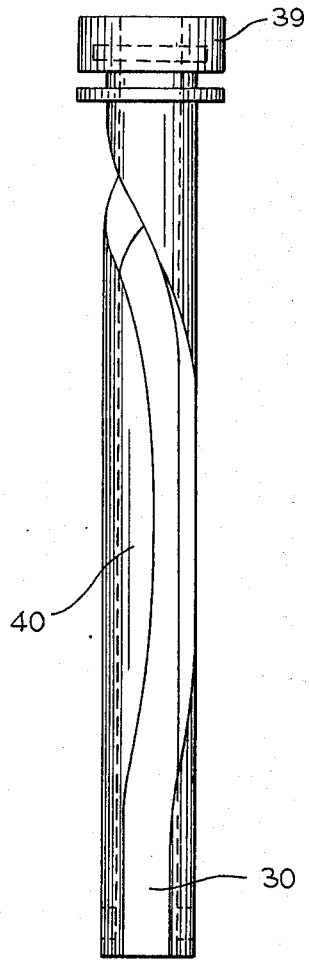
FIG. 6 is a side elevation of the piston.

FIGS. 5 and 6 show details of the cylinder-piston unit 16 by which the auxiliary thread guide 17 is driven and guided under control on a path of movement defined by guide means. The cylinder-piston unit 16 consists essentially of the cylinder 31 with fluid pressure-medium connections 32, 33, 34, a fixed mandrel 35 coaxially mounted in the cylinder, two annular pistons 38, 39 and a piston rod 20 carrying the thread guide 17. The fixed mandrel 35 has on its one end a fluid pressure medium distributing channel 36 and carries on its free other end a slide block 37 which rides in the slide track 30 in the tube 40. The piston rod 20 consists of two coaxial tubes 40, 41, the inner tube 40 bearing the annular piston 39 and having the longitudinal, curvate slot track 30. The outer tube 41 is sealed against fluid pressure medium losses.

Further details of such a fluid pressure medium-controlled cylinder-piston unit with an inner guide track are found in German Utility Model 7,407,372. [2] In modification and further development of the utility model construction, the cylinder-piston unit shown in FIG. 5 is constructed as a multiposition cylinder in which, besides the annular piston 39, there is also provided an additional control piston 38. Hereby the entire course of movement of the auxiliary thread guide is integrated in a single drive and control unit, while a preselectable waiting time can be programmed for the thread catching position in the control circuit in a known manner. 2. Also U.S. application Ser. No. 456,222

When the thread guide 17 is pivoted into the traverse plane and the thread guide 4 and the endless cross-spiral groove 13 are traversing the thread to the left as viewed in FIG. 1, the thread 14 is led into the space between the bar 42 and the front-plate of the head 2. Whereas the thread is forced to bend between the thread guide 4 and the thread-guide groove 13 as it rides up the angled thread lift-off part or edge 22 of the thread guide 17, during which step the thread moved out of the traverse plane, the bar 42 prevents the thread 14 from jumping out of the traverse thread guide 4. As soon as the thread is caught in the thread catching eye or pigtail 21 outside of the traverse plane, and the thread guide 4 has left the action range of the bar 42, the thread slips out of the traverse thread guide 4.

The cylinder 16 of the subject invention is closed at its upper end by the plug 44 containing the passage 36 and secured in the cylinder by the set screw 45. The lower end of the cylinder contains a sleeve 46 fixedly mounted therein, a ring 47 screw threaded in the lower end, and a gasket 48 compressed therebetween to provide a fluid tight seal about the piston rod 20 which extends coaxially through these three members.

Figure 7:
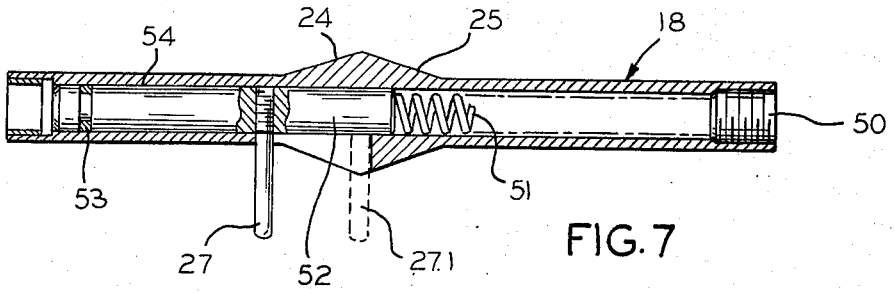
FIG. 7 is a diametric section of the mandrel of the thread changeover mechanism.

Referring to FIG. 7, the mandrel 18 has a pneumatic system for shifting the pin 27. The mandrel is tubular, the free end being closed by the plug 50. A helical spring 51 is compressed between the plug 50 and a piston 52 in which the pin 27 is mounted. A piston ring seal 53 is provided at the opposite end of piston in the tubular cylinder segment 54. Fluid pressure applied at the open end of tubular segment 54 drives the piston to the right as viewed in FIG. 7, shifting the pin 27 to its limit position 27.1. Upon release of the pressure, the spring 51 returns the piston 52 and the pin 27 to the home position of the latter.

This auxiliary thread guide 17 is longitudinally adjustably mounted in the lower end of the piston rod by mounting the guide in radial apertures through the tubes 40 and 41 of the piston rod and a cylindrical plug 55 slidably fitted in the lower end of the inner tube 40. The plug has a threaded shank 56 on which the nut 57 is threaded. By drawing up the nut, the bar or rod of the auxiliary thread guide 17 is bound by the slight misalignment of the radial aperture in the plug 55 with the apertures in the tubes 40 and 41.

Figure 8:
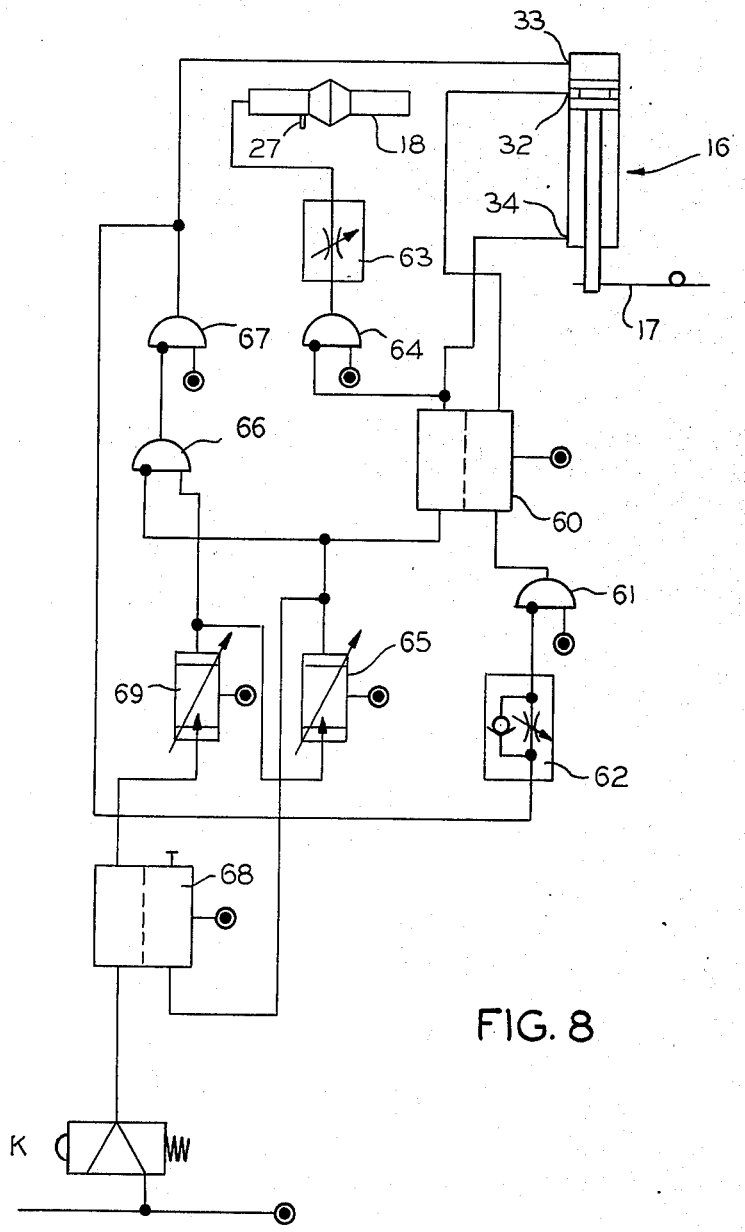
FIG. 8 is a diagrammatic view of the pneumatic system and controls for the thread changeover mechanism.

The control of the cylinder-piston systems takes place through a program system, the controls of which are set in correspondence to the particular requirements of the thread changeover. The following is a description of the modus operandis of the thread changeover in connection with the pneumatic control system shown in FIG. 8.

At the beginning of the bobbin change, which is initiated through a time relay or through switching contacts controlled by the increasing winding diameter, the auxiliary thread guide 17 is still in the waiting position, where it resides during the winding operation, Here, the cylinder-piston unit 16 is in the position shown in FIG. 5, in which pneumatic pressure is applied at connections 33 and 34, and the cylinder is ventilated via connection 32 and a signal storer 60. The main piston 39 abuts in this position against the control piston 38. After contacting for the triggering of the thread change, for example through contactor K, by which, via a signal storer 68, a pneumatic time relay 69 is operated, from which a second relay 65 is operated, the cylinder is completely ventilated via the connection 33, and the pneumatic pressure at connection 34 presses the two pistons 38 and 39 in common into the upper end position, in which the auxiliary thread guide 17 is rotated into the thread catching position (FIG. 3) and the thread guide segment 22 penetrates the traverse plane. The auxiliary thread guide remains in this position until the pneumatic fluid no longer flows out at the connection 33, and a "NOT element" 61 with preengaged choke 62 in the circuit responds and switches the storer 60 in such a manner that the connection 32—with ventilation of the cylinder at connection 34—is pressure-active. The choke 62 is adjustable for the setting of a selectable staying time of the auxiliary thread guide 17 in the thread catching position.

By action on the piston 39 via connection 32, the piston, under rotational control by the guide slot or track 30, travels to its lower position. Before this process the thread 14 is prevented from being further traversed by the reciprocating traversing thread guide 4 when it moves along the thread guide part 22 until it falls into the thread catching eye or pigtail 21, where it is caught. By a bar 42 just above the guide slot 5, the thread is prevented from being lifted out of the traverse thread guide 4 before it is caught because, due to the increase in thread tension, it could possibly slide back into the traverse plane.

In the movement of the auxiliary thread guide into the lower position (FIG. 2), the thread, held fast in the thread catching eye 21 and running therethrough and still being wound on the finished bobbin 11, is guided around the mandrel 18 and drawn downward into a thread loop. The thread guide 17 is pivoted here in such a way that the thread guide part 22 does not contact the empty tube 10.2 or other parts of the bobbin revolver. A slipping off by the further traversed thread from the mandrel 18 to the traverse stroke center is prevented by the thread stop 23. The thread loop in the running over the mandrel is divided into the conical slide surfaces 24 and 25, the thread segment running from the fixed thread guide 8 to the thread catching eye 21 being drawn over the guide surface 24 and the thread segment between the thread catching eye 21 and the friction roller 7 can slide down on the guide sufrace 25 of the mandrel. After passing the empty tube 10.2, the auxiliary thread guide 17 is rotated inwardly by the upper curve part of the control slot or track 30 of the piston rod so that the thread segment running in from the fixed thread guide 8 comes into the range of the thread catching notch 43 on the empty tube. By the tensioning of the thread between the thread catching notch on the empty tube 10.1 and the still-driven finished bobbin 11, the thread, with the piston rod 20 in the lower position, is severed by severing cutter 19. While the cut-off thread tail is wound on the finished bobbin 11, the oncoming thread is now wound on the empty tube 10.2. First of all, however, the oncoming thread is prevented from entering the traverse plane because it cannot slide automatically along the surface 24 of the mandrel 18. The latter is accomplished by pneumatic shifting of the pin 27 to the position 27.1. In the time span required, which is settable by the choke 63, and during which the thread is guided outside the traverse stroke of the traverse thread guide 4, a thread reserve of several turns is wound on the empty tube. Then the thread slides along the mandrel and falls into the traverse plane, where it is automatically caught by the traverse thread guide 4 and is traversed by the traverse guide 4 and grooves 13. In the position of the mechanism as shown in FIG. 2, the oncoming thread is not caught by the stop pin 23 on the free end on the mandrel.

As long as the piston 20 was moved into its lower end position and the cylinder 31 was ventilated over the storers 60 and 68 through the connection 34, a further "NOT element" 64 provided in the control of the cylinder-piston unit 16 did not respond. In the end position, when the control fluid is expelled, however, it switches and initiates with the formation of the thread reserve the return stroke of the piston 20. The return stroke takes place at expiration time of the adjustable, pneumatic time relay 65, which acts via the signal storer 60 upon the cylinder 16 by applying pneumatic pressure at the connection 34. Simultaneously from the time relay 65, via the two "NOT elements" 66 and 67, connection 33 also has pneumatic pressure applied to the top of the cylinder. The two pistons are moved by the pressure applied at connections 33 and 34, and the cylinder is ventilated via the connection 32. The piston rod is returned to the waiting position described above. The cylinder-piston unit remains in this waiting position until the next winding is formed and, through a contact, the signal is given for the next thread changeover.

The bobbin revolver is simultaneously or thereafter rotated clockwise as viewed in FIG. 2 from the illustrated position. The empty tube 10.2 raises the friction drive and traverse roller 7, thereby raising the head 2 with or without auxiliary head-lifting mechanism, until the empty tube is approximately directly below the roller 7. The revolver is arrested in this position until the signal is given for the next thread changeover. In the meantime, the full winding bobbin or package 11 and the roller 7 having separated, the chuck 9.2 is arrested, and the package or bobbin 11 is removed and replaced by an empty tube. At the initiation of the next thread changeover, the revolver 12 orbits the two chucks 9.1 and 9.2 and the members thereon to the position shown in FIGS. 1 and 2.

As a further alternative, the chucks 9.1 and 9.2 can be driven by a central drive within each chuck to bring the chucks up to winding speed and to drive the chucks during the winding operation. Still further, the central drive may be used for acceleration and a friction drive roller other than the roller 7 may be used to take over and drive the tube and its winding in the winding position. In either case, the roller 7 preferably is retained—serving in such cases only as a thread traversing device without any driving contact with the winding tubes and/or windings thereon.

The invention is hereby claimed as follows:

1. A thread changeover combination for shifting thread from a thread winding package to an empty winding tube without loss of thread comprising a bobbin revolver adapted to rotate and stop in predetermined positions, at least two rotatable chucks mounted on said revolver and adapted to orbit as said revolver rotates between at least a thread winding position and a winding package removal position, each chuck being adapted to releasably hold a winding bobbin or tube thereon, means for traversing the thread in a traverse plane across the winding of the bobbin or tube on the chuck which is in the winding position, means for rotatably driving each winding on each chuck while it is in the winding position, and a thread changeover mechanism embodying an auxiliary thread guide having a thread guide surface at an obtuse angle relative to said traverse plane, means for moving a thread-engaging portion of said guide surface into and out of said traverse plane adjacent one end of the traverse stroke of the thread, said thread guide further having a thread trap at the end of said guide surface which is remote from said thread-engaging surface, said thread trap lying outside said traverse plane, said thread trap being adapted to receive and hold therein thread which is running to the winding package when said thread runs along said guide surface after its thread-engaging portion has moved into said traverse plane and the thread moves along said guide surface to said thread trap, and means for shifting said thread guide with the thread running through said thread trap to a position wherein the running thread can be caught by another of said chucks or the winding tube or bobbin thereon.

2. The combination as claimed in claim 1 wherein said thread guide is activated by the piston of a fluid-operated piston-cylinder unit having means to move said thread guide linearly and pivotally into, between and out of said positions of said thread guide.

3. The combination as claimed in claim 2, said means to move said thread guide being a linearly movable piston rod projecting from said cylinder and on which said thread guide is mounted, and cam means within said cylinder for rotating said rod and thereby pivoting said thread guide.

4. The combination as claimed in claim 3 wherein said cam means comprises a longitudinal, curvate slot or groove in said piston rod, and a stationary member within said cylinder and slidably riding in said groove or slot.

5. The combination as claimed in claim 4 wherein said cylinder-piston unit has means to move said piston to three successive positions in which, successively, said piston rod and said cam means shift said thread guide successively from rest position to traversing-thread-engaging-position to running-thread-catching position.

6. The combination as claimed in claim 3, and means for mounting said thread guide in longitudinally adjustable positions on the projecting end of said piston rod.

7. The combination as claimed in claim 1, and a fixed, substantially horizontal mandrel having a free end and slanted toward said free end at an acute angle toward said traverse plane and intermediate of said positions, said mandrel having surfaces contacted by the running thread when said thread guide moves from the first-mentioned to the second-mentioned position.

8. The combination as claimed in claim 7, and a thread stop on the free end of said mandrel to prevent the running thread from slipping off the free end of said mandrel when said thread guide is in the second-mentioned position.

9. The combination as claimed in claim 7, said mandrel having biconical segment positioned substantially opposite to an end of the traverse stroke of the thread in said traverse plane.

10. The combination as claimed in claim 9, the thread contacting surface of the conical portion of said biconical segment which is remote from said free end sloping toward said free end at an acute angle to said traverse plane, and pin means movable along said conical portion for pushing the thread toward said free end.

* * * * *